US005549933A

United States Patent [19]

Adams et al.

[11] Patent Number: 5,549,933

[45] **Date of Patent: *Aug. 27, 1996**

[54] PROCESS FOR PAINTING SNOW

[75] Inventors: Theodore P. Adams, Edina; Mark W. Kroll, Minnetonka; Karl Kroll, Maple Grove, all of Minn.

[73] Assignee: Creative Toy Corporation, Minneapolis, Minn.

[ * ] Notice: The term of this patent shall not extend beyond the expiration date of Pat. No. 5,165,966.

[21] Appl. No.: 395,892

[22] Filed: Feb. 28, 1995

Related U.S. Application Data

[63] Continuation of Ser. No. 979,252, Nov. 20, 1992, abandoned, which is a continuation-in-part of Ser. No. 669,896, Mar. 15, 1991, Pat. No. 5,165,966.

[51] Int. Cl.[6] ..... B05D 1/02; B05D 5/00; B05D 7/00

[52] U.S. Cl. ..... 427/421; 427/136; 427/137; 427/212; 427/256; 434/84; 106/160.1

[58] Field of Search ..... 426/540; 106/137, 106/204, 214, 135; 427/256, 136, 137, 212, 421; 434/84

[56] References Cited

U.S. PATENT DOCUMENTS

| | | | |
|---|---|---|---|
| 3,264,114 | 8/1966 | Glicksman et al. | 426/540 |
| 3,511,667 | 5/1970 | Schramm et al. | 426/540 |
| 3,920,855 | 11/1975 | Dawson et al. | 426/540 |
| 3,932,676 | 1/1976 | Janicki et al. | 426/540 |
| 4,187,323 | 2/1980 | Gidlow | 426/540 |
| 4,475,919 | 10/1984 | Woznicki et al. | 426/540 |
| 5,165,966 | 11/1992 | Adams | 427/256 |

FOREIGN PATENT DOCUMENTS

| | | | |
|---|---|---|---|
| 573276 | 3/1959 | Canada | 426/540 |
| 0224485 | 7/1985 | Germany | 426/540 |
| 2117215 | 10/1983 | United Kingdom | 426/540 |

*Primary Examiner*—Anthony Green
*Attorney, Agent, or Firm*—Joel D. Skinner, Jr.; Hugh D. Jaeger

[57] ABSTRACT

A paint formulation is disclosed which will paint snow without harming either animal or plant life. The paint may be pre-formulated in a powdered form as is prepared for use by merely adding water. A process of allowing one to paint or draw on snow whereby a coloring agent, such as food coloring, is mixed with a gelling agent, such as household gelatin, and applied with a spray or squirt gun. When the gel solution contacts the cold snow, the gel solution quickly sets up and is prevented from dissipating as snow undergoes partial melting. When snow melts, the gel liquefies and disappears with runoff water.

6 Claims, 1 Drawing Sheet

PROCESS FOR PAINTING SNOW

CROSS REFERENCES TO CO-PENDING APPLICATIONS

This patent application is a continuation of U.S. Ser. No. 07/979,252, filed Nov. 20, 1992, and now abandoned, which is a continuation-in-part of U.S. Ser. No. 07/669,896, filed Mar. 15, 1991, entitled "Process for Painting Snow," now U.S. Pat. No. 5,165,966, issued Nov. 24, 1992, assigned to the same applicant.

BACKGROUND OF THE INVENTION

1. Field of the Invention

The present invention is for illustrating or coloring on snow or ice, and more particularly, pertains to coloring or painting snow or ice with a biodegradable solution.

2. Description of the Prior Art

There is an unmet need for a safe and reliable means of painting snow. Construction and underground line repair crews need to outline a digging area in the snow. Ski areas need obvious warnings of correct routes and danger areas. Artists and children enjoy printing in snow. The decoration of a Snow-Man or other snow-sculptured objects is a very entertaining pastime for children. Unfortunately, conventional spray-paints are hazardous to animal and plant life. They are too toxic for the use of small children and the residue is harmful to plants and grass. A prior art nontoxic coloring agent is the FDA-approved food coloring. These colorings may be mixed with water and sprayed on snow. However, the food colored water has too high a density, specific heat, and heat of fusion to readily bond to snow. The high density allows it to "burn through" the snow, rather than sit on the surface. The high specific heat and heat of fusion means that it is hard to freeze the colored water before it has an opportunity to burn through the snow. The high specific heat and heat of fusion also combines with the low viscosity of the colored water to allow it to roll down vertical surfaces before freezing. Thus, it is unsuitable for painting the Snow-Man. Hence, there is an unmet need for safe, non-toxic, and reliable paint for coloring snow.

Using colored water for this purpose does not work because the water melts the snow and runs. In addition, water (ice) melts at too low a temperature. If colored water is used to color snow it runs before freezing and is very difficult to control. It also runs quickly under partial melting conditions. Other forms of paints may not totally melt and disappear upon spring thawing and may be toxic to children who might eat snow containing the coloring agent. The materials used in this invention are edible and otherwise environmentally harmless.

The present invention overcomes the disadvantages of the prior art.

SUMMARY OF THE INVENTION

The general purpose of the present invention is to provide a process of allowing a person to paint or draw on snow. A coloring agent, such as food coloring, is mixed with a gelling agent, such as household gelatin, and applied via a spray or squirt gun. When the gel solution contacts the cold snow, the gel solution quickly sets up (gels), and is prevented from dissipating as snow undergoes partial melting. When snow melts, the gel liquefies and disappears with the runoff water.

According to one embodiment of the present invention, a process is provided including the use of animal protein based gelatin mixed with water and food coloring to be sprayed on snow or other cold surfaces to create pictorial or geometrical images. The gelatin based coloring gels very quickly on contact with snow and remains in a gel state until temperatures exceed 50–70 degrees. The material can be stored in a dry state (powder) and mixed with water just before use. A spray bottle with an adjustable nozzle is an applicator for toy applications (graffiti, etc.)

Significant aspects and features of the present invention include a snow paint which is biodegradable and environmentally safe, is edible and totally nontoxic, is of a higher melting temperature than snow, but disintegrates in normal spring temperatures, and leaves no residues to clean up in spring or summer.

Having thus described the embodiments of the present invention, it is a principal object hereof to provide a process for painting snow or cold surfaces with a colored gelatin based solution.

One object of the present invention is a process of mixing a coloring agent (snow color) with an organic biodegradable non-toxic gelatin (snow gel), such as animal-based gelatin, to paint the snow or any other cold surface (snow paint).

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

The mixture of gelatin, food coloring and water is very forgiving with a wide range of acceptable variations. About ¼ ounce of gelatin mixed with five drops of concentrated food coloring and one cup of water works well. The recipe could be varied by 100% in any variation and still works well. The material sets up faster with higher concentrations of gelatin, but could cause problems with the spray nozzle if the concentration is too high. The material could be applied by a hand-held spray applicator for toy applications or by a motorized pump for commercial applications, such as the Winter Carnival in St. Paul, Minn.

In the toy applications, the dry gelatin powder and food coloring could be packaged in individual packets containing the proper amount of gelatin to mix with one bottle full of water that comes with the spray applicator. Each packet would contain a mixture of a different color. In the commercial application, the colored gelatin mix could be sold in bulk form. It could be applied by the same type of equipment used for spraying insecticides and herbicide. One type of dry gelatin is Knox gelatin.

MODE OF OPERATION

Figure 1:
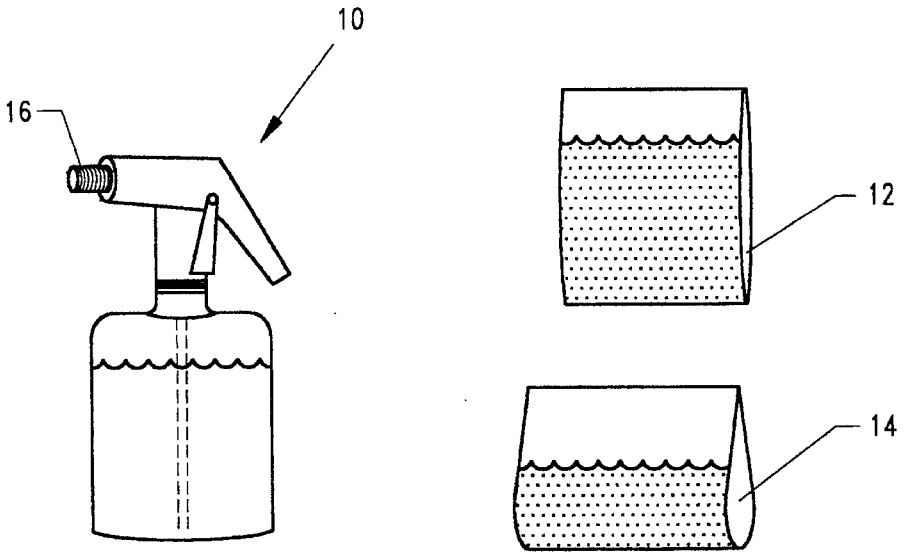
FIG. 1 illustrates an applicator for a process.

In FIG. 1, a container 10 is filled with warm water, and a gelatin packet 12 and an optional dye packet 14 are added. The gelatin can also be colored. The container is vigorously shaken for about one minute to dissolve the gel and mix the gel and optional dye. A nozzle 16 on the container 10 is adjusted for misting for overall background coloring or jetting for narrowly defined images. The gel and coloring agent can be contained in a plastic lined paper packet or other suitable container. The gel, coloring agent and spray bottle can be packaged and sold individually or as a group.

Figure 2:
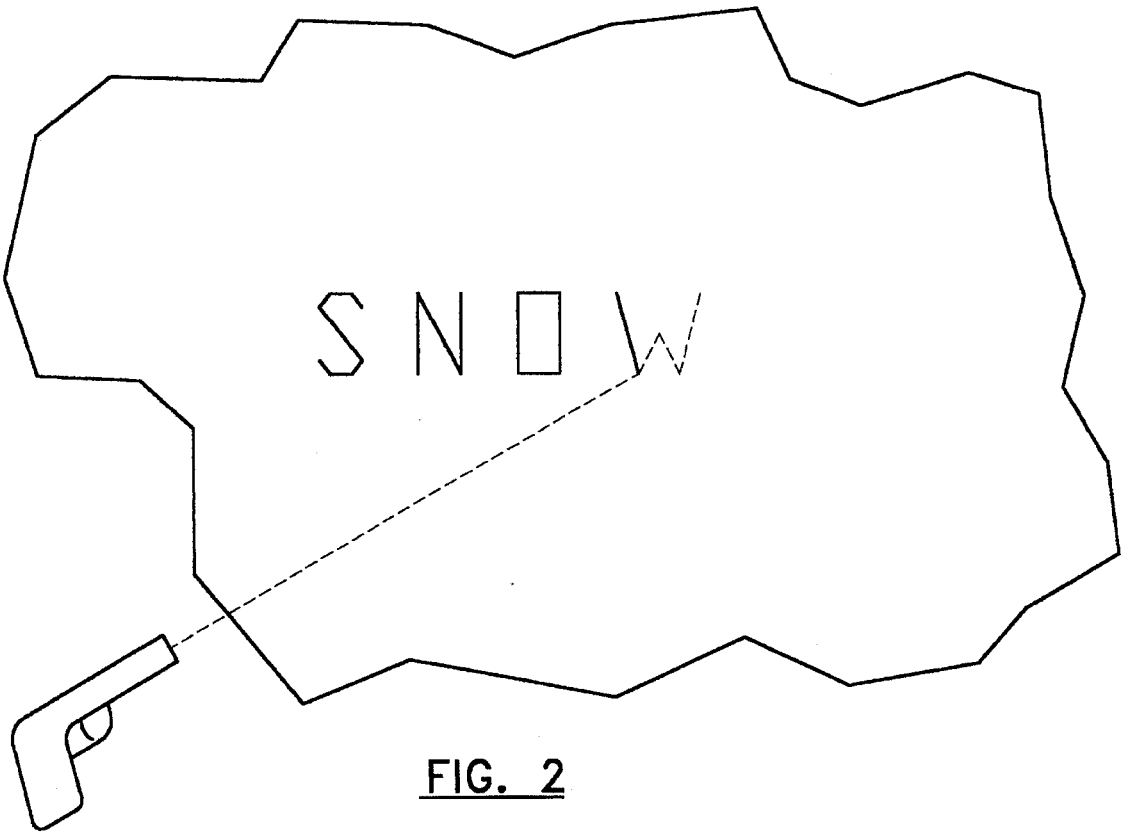
FIG. 2 illustrates the process of the present invention.

In FIG. 2, the use of a combination of a gelling agent, coloring agent, and water is for painting or coloring snow or other cold surfaces. The gelling agent is natural or organic gelatin, and the coloring agent is food coloring dye. The gelling agent can also be a synthetic organic or inorganic gelling chemical. The painting solution is used in conjunction with a spray apparatus to coat snow or other cold surfaces. The spray apparatus has an adjustable nozzle to control the definition of the spray. The system is used as a toy for painting graphics or images on snow. The system is used in commercial applications, such as marking ski trails, painting snow sculptures, etc.

DESCRIPTION OF AN ALTERNATIVE EMBODIMENT

The preferred embodiment of the invention is a paint comprised of approved food colorings, water and an enzymatically hydrolyzed gel with a molecular weight of approximately 2000, and in a range of 100 to 100,000.

The enzymatically hydrolyzed gel with the food coloring all dissolved in water decreases the high specific heat and heat of fusion. It also increases the viscosity so that it can paint vertical surfaces such as snow-men.

Animal connective tissue is primarily collagen which is a multi-stranded twisted "rope" of long proteins. With boiling, the strands unwind and the single strands become what is popularly known as animal "gelatin". Gelatin makes a good snow paint substrate, but its propensity for gelling means that it is not cold-water soluble. Thus, it persists throughout the winter season until the snow is totally melted into the ground. While this is an advantage for "permanent" markings, such as ski trails, it is a disadvantage for children's free form art.

The long strands of gel may be broken up by a process of enzymatic hydrolization. This results in a lowering of molecular weight from about 100,000 to about 2,000. This removes the gelling ability and gives a substrate with cold water solubility. The reasons that the cold water solubility is important is that sunny days melt a thin layer of snow each day. This then typically refreezes during the night to help form the crust that is felt on mature snow. The daily surface melting produces enough water so that the enzymatically hydrolyzed gel snow paint disappears within 2 or 3 sunny days Thus, the "slate is erased", and a child is free to use the snow for another painting session.

An important specification is that the snow-paint basic substrate must be very soluble in warm water so that it is easy for children to formulate with tap water. There are other inherently nontoxic products which have similar water-dissolved specific heat, heat of fusion, density and viscosity. These include various other cellulose and collagen products, poly saccharides, proteins and peptides. Common food items include sugar, flour, corn starch, and dry yeast. Common non-food items include chalk and finely powdered sawdust.

Table 1 lists suitable non-toxic compounds.

TABLE 1

| Non-Toxic Compounds |
|---|
| Organic compounds |
| Organic compounds with a preservative |
| Animal derived compounds |
| Plant derived compounds |
| Cellulose based compounds |
| Poly-saccharide compounds |
| Protein compounds |
| Peptide compounds |
| Amino acid compounds |
| Sugar compounds |
| Flour compounds |
| Sawdust compounds |
| Yeast compounds |
| Corn starch compounds |
| Paint powder compounds |

Various modifications can be made to the present invention without departing from the apparent scope hereof.

We claim:

1. A process comprising the steps of:

a. mixing a nontoxic substrate, coloring agent and water in an aqueous solution for painting or coloring snow or ice;

b. filling a sprayer apparatus with said solution; and c. spraying said solution on snow or ice to form a coating, whereby said solution gels upon contact with said snow or ice.

2. The process of claim 1 wherein the nontoxic substrate is an animal derived, collagen based gelatin.

3. The process of claim 1 wherein the gelatin has a molecular weight of <100,000.

4. The process of claim, 2, wherein the gelatin is enzymatically hydrolized.

5. The process of claim 4, wherein the gelatin has a molecular weight of approximately 2,000.

6. A process for painting or coloring snow or ice comprising the steps of:

a. mixing water, a nontoxic substrate and a food coloring agent in an aqueous solution; and b. coating said mixture on ice or snow, whereby said solution gels upon contact with said ice or snow.

* * * * *